US006015098A

United States Patent [19]

Krueger

[11] Patent Number: 6,015,098

[45] Date of Patent: Jan. 18, 2000

[54] CONNECTOR FOR LAWN SPRINKLER

[76] Inventor: Gerald Krueger, 106 Lyon St., Marquette, Wis. 53947

[21] Appl. No.: 09/170,743

[22] Filed: Oct. 13, 1998

[51] Int. Cl.[7] ..... B05B 3/06; B05B 15/06

[52] U.S. Cl. ..... 239/261; 239/264; 239/276; 239/279

[58] Field of Search ..... 239/273, 276, 239/279, 225.1, 261, 264; 285/272, 275

[56] References Cited

U.S. PATENT DOCUMENTS

| | | | |
|---|---|---|---|
| 1,780,332 | 11/1930 | Brickhill | 239/261 X |
| 2,323,701 | 7/1943 | Barksdale | 239/276 X |
| 2,731,296 | 1/1956 | Griffith | 239/279 X |
| 2,979,272 | 4/1961 | Thorrez | 239/276 X |

*Primary Examiner*—Lesley D. Morris
*Attorney, Agent, or Firm*—R. Jonathan Peters

[57] ABSTRACT

The invention provides a connector for a rotatable lawn sprinkler mounted on a cylindrical stand pipe, and comprises two cylindrical members arranged co-axially with respect to the longitudinal axis of the stand pipe. A cylindrical sleeve, as the female member of the connector, has an open-ended longitudinal bore and terminates at one end with an outwardly extending annular shoulder seated on the marginal wall of the stand pipe and is secured thereto. A cylindrical stem, as the male member of the connector, having an open-ended longitudinal bore and terminates near one end with an outwardly extending annular collar is co-axially disposed and slidably engagable with the sleeve so as to be freely rotatable in the bore of the sleeve. The annular collar of the stem is supportably engaged with the annular shoulder of the sleeve. The upper section of the stem is adaptable for secure engagement with the rotatable lawn sprinkler. A hose is connected near the bottom of the stand pipe, and when water is supplied through the hose to the stand pipe and through the bores of the sleeve and stem, which all are in fluid communication, because the sprinkler is provided with one or more restricted orifices, the resulting water pressure effects common rotation of the stem and the lawn sprinkler.

3 Claims, 2 Drawing Sheets

CONNECTOR FOR LAWN SPRINKLER

FIELD OF THE INVENTION

This invention relates to a connector for a lawn sprinkler. In its more specific aspect, this invention relates to a connector for rotatabley mounting a lawn sprinkler on a vertically disposed stand pipe connected to a water source.

BACKGROUND AND PRIOR ART

Lawn sprinklers having an oscillating or revolving sprinkler head are common place. The coupling or mechanism for connecting the sprinkler head with the base member are relatively complicated. Such coupling mechanisms are shown, for example, in U.S. Pat. Nos. 370,922; 2,271,823; and 2,883,113. Typically, known connecting mechanisms include threaded couplings, several parts, and/or relatively complicated shapes and configurations.

My invention has as its purpose to provide a connector for a rotatable sprinkler that has no threaded couplings, and is relatively simple in construction and application.

SUMMARY OF THE INVENTION

Broadly, the invention provides a connector for a rotatable lawn sprinkler mounted on a vertically disposed, cylindrical stand pipe, or the like, extending from a suitable base, footing, pedestal or support, arranged or positioned on the ground. The connector includes two cylindrical members arranged co-axially with respect to the longitudinal axis of the stand pipe. A cylindrical sleeve, as the female member of the connector, has an open-ended longitudinal bore and terminating at one end with an outwardly extending annular shoulder. The sleeve is adaptable for coaxial disposition with the stand pipe such that the shoulder is seated on the marginal wall of the stand pipe and is secured thereto as by welding, brazing, etc. A cylindrical stem, as the male member of the connector, having an open-ended longitudinal bore and terminating near one end with an outwardly extending annular collar is coaxially disposed and slidabley engagable with the sleeve so as to be freely rotatable in the bore of the sleeve. The annular collar of the stem is supportably engaged with the annular shoulder of the sleeve. The upper section of the stem is adaptable for secure engagement or connection with the rotatable lawn sprinkler. A hose, such as a typical garden hose, extending from a water source is connected near the bottom of the stand pipe, and when water is supplied through the hose to the stand pipe and through the bores of the sleeve and stem, which all are in fluid communication, because the sprinkler is provided with one or more restricted orifices, the water pressure effects common rotation of the stem and the lawn sprinkler.

DETAILED DESCRIPTION OF THE INVENTION AND SPECIFIC EMBODIMENTS

Figure 1:
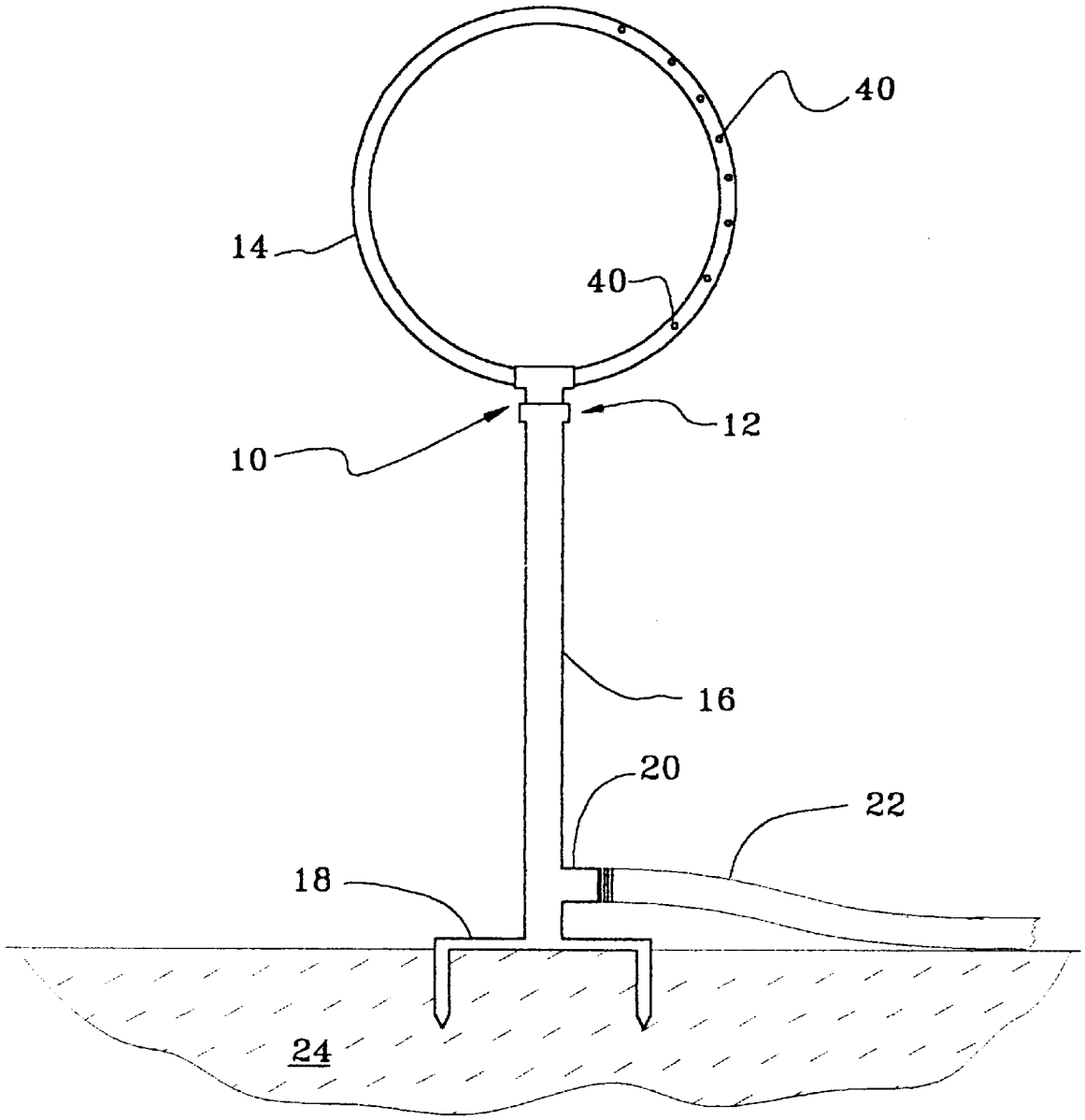
FIG. 1 is a front elevational view of a lawn sprinkler embodying the connector element of my invention.

Referring to the drawings wherein like reference numerals refer to similar parts throughout the several views, and certain dimensions exaggerated for purposes of clarity, there is illustrated in FIG. I a rotatable lawn sprinkler 10 utilizing the connector of my invention, indicated generally by the numeral 12. The lawn sprinkler, such as of the type disclosed and claimed in my co-pending patent application Ser. Nos. 29/086187, 29/086164, 29/086236, 29/086169 now U.S. design Patent No. D 412553, 29/086235, 29/086166, includes a sprinkler head 14 supported by a vertically disposed cylindrical stand pipe 16, which in turn is supported at its base by a stand 18 such as of the type disclosed and claimed in co-pending patent application Ser. No. 29/086238. All of the aforesaid co-pending patent application are in the name of the same inventor as is the subject application. As with a conventional sprinkler, the head has a plurality of spaced openings or orifices that restrict the flow of water and direct the water in a particular pattern. The lower section of the stand pipe 16 is provided with a coupling 20 suitable for attaching a hose 22 for supplying water to the sprinkler. It will be observed that the stand or support base 18 is pushed into the ground 24, and hence the sprinkler may be moved to different position of the lawn or garden as desired. It should be understood that in describing the connector for use with a rotatable sprinkler, the term "sprinkler" is used in its common meaning but it is sometimes thought, and so understood, that it is the sprinkler head from which the water is emitted and is the specific component that rotates.

Figure 2:
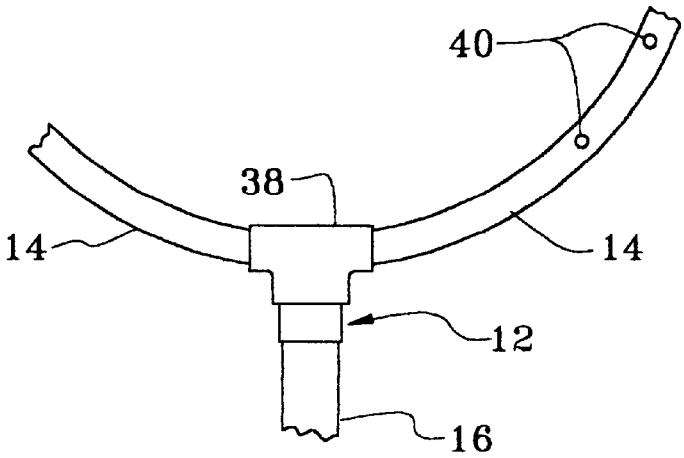
FIG. 2 is a fragmementary elevational view of the connector showing in detail the features thereof.
Figure 3:
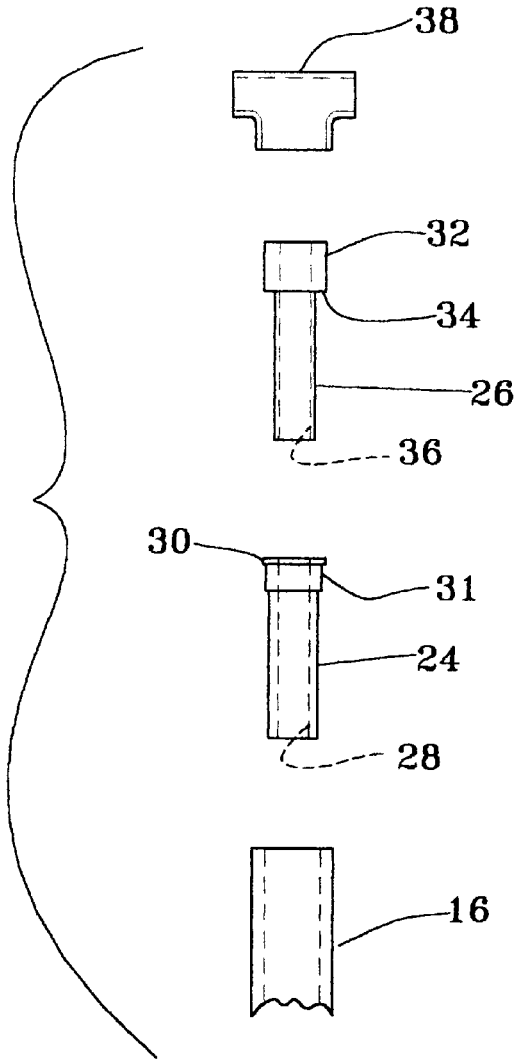
FIG. 3 is an exploded view of the specific features of the connector shown in FIG. 2.

Referring now more specifically to FIGS. 2 and 3, there is shown in greater detail the connector 12, which preferably is made of brass or other suitable metal in order to provide durability and wear and to minimize or substantially eliminate the possibility of leaks. Where desired, however, the connector can be formed of a suitable plastic. The connector comprises a female member 24 and male member 26, such that upon co-axial assembly of these two members along with the other components of the sprinkler system, the male member is free to rotate in common with the sprinkler head 14, as explained hereinbelow and for the reason explained in detail.

Female member 24, which is adaptable for vertical disposition, is a cylindrical sleeve having an open-ended longitudinal bore 28 extending the full length thereof The sleeve 24 terminates at its upper end, when viewed in its vertical disposition, with an annular shoulder 30 having top and bottom substantially flat or planar surfaces. It will be observed that stand pipe 16 is adaptable to receive sleeve 24, and thus the inside diameter of the stand pipe is sufficiently larger than the outside diameter of the sleeve so as to permit insertion of the sleeve but not so large as to allow for a loose, rocking or wobbly fit. Where desired, the upper section of the sleeve 24, adjacent the shoulder, is slightly enlarged or flared at 31 to provide for a friction fit between the stand pipe and sleeve, and because the sleeve preferably is brass or other hard metal and the stand pipe is copper or other relatively softer metal, the friction fit or press fit can be easily accomplished by forcing the sleeve into the cylindrical opening of the pipe. Also, the sleeve should be of sufficient length to provide for stability of these two adjoining members. When the sleeve is inserted into the stand pipe so as to provide for co-axial alignment of the sleeve, stem and pipe, the outwardly extending annular shoulder 30 is effectively seated on the marginal edge or rim of the cylindrical stand pipe. In this manner, the bore of the sleeve is in fluid communication with the cylindrical bore of the stand pipe. The sleeve is securely engaged with the stand pipe as by welding, so when water is passed through, the sleeve remains stable and in place and there is no leakage between these two members.

Male member or stem 26 of the connector 12 comprises a cylindrical shank of a first diameter having an upper extension 32, as viewed in its vertical disposition, of a second larger diameter thereby forming outwardly extending annular collar 34 having a substantially flat or planar bottom surface for effecting seating contact with shoulder 30, as explained below in greater detail, and an open-ended bore 36 extends the full length of the stem member 26. Members 24 and 26 are adaptable for coaxial disposition such that cylindrical sleeve 24 is adaptable to receive the cylindrical stem 26 so that the respective bores 28 and 36 are in fluid communication, and therefore are co-axial with the longitudinal axis of and in fluid communication with the cylindrical stand pipe 16. It thus will be observed that the outside diameter of stem 28 is slightly smaller than the inside diameter of the sleeve 26 so as to permit a snug fit but allowing for the stem to freely rotate. Hereto, the respective dimensions, including the length of the stem, should be sufficient so as to substantially eliminate any loose or rocking fit and to substantially eliminate the possibility of water leaking between the inside wall of the sleeve and outside wall of the stem. Thus, when the stem is inserted into the sleeve, collar 34 mates with and seats on shoulder 30, thereby supporting the stem and holding the stem in place but still allowing for free rotation of the stem.

The stem 26 is adaptable for engagement with the sprinkler head 14, and it should be understood that this connection between the stem and sprinkler head can be altered depending largely upon the particular design or configuration of the sprinkler. The sprinkler illustrated in FIG. 1 has a substantially oval sprinkler head so that the head can be connected at its center bottom to the stem. In order to accomplish this connection, there is provided a T-coupling 38. Thus, sprinkler head 14 is split or sectioned at its bottom center to form two ends, and these ends are inserted into the horizontal arms of the T-coupling so as to unite the head with the coupling as by soldering. Similarly, extension 32 of stem 26 is inserted into the vertical section of the T-coupling so as to engage or attach the sprinkler with the stem of the connector 12. The parts connected to the T-coupling are welded, if metal, or otherwise affixed or connected in position. It thus will be observed that fluid communication is provided from the hose, through the stand pipe, the connector and then to the sprinkler.

Upon assembly of the sprinkler, including the connector 12, and the sprinkler positioned at the desired location, and the hose extending from a suitable water source is connected to the stand pipe. When water is supplied to the system, the sprinkler has a plurality of restricted openings or orifices 40, and the resulting water pressure causes or effects the common rotation of the stem 26 and sprinkler head 14. That is, because the stem 26 is free to rotate by reason of its fit with the sleeve 24, and because the stem is attached to the sprinkler head, as by T-coupling 38, the stem and sprinkler rotate in common. The snug fit between the sleeve 24 and stem 26, and the weight of the sprinkler head, essentially prevents unwanted water leakage between these parts. In this manner, the water stream is directed in a desired pattern.

It will be observed that by reason of my invention numerous advantages are achieved in providing for a relatively simple, fast and inexpensive connector for a sprinkler. Further, it should be understood that the foregoing detailed description has been given for clearness of understanding only, and no unnecessary limitations should be understood therefrom, as modifications will be obvious to those skilled in the art.

What is claimed is:

1. A connector for a rotatable lawn sprinkler for mounting on a vertically disposed, cylindrical stand pipe having a cylindrical wall, comprising: a cylindrical sleeve having an open-ended longitudinal bore and terminating at one end with an outwardly extending annular shoulder, said sleeve adaptable for coaxial disposition with the stand pipe such that said shoulder is seatable on a marginal wall of the stand pipe and securable thereto; a cylindrical stem having an open-ended longitudinal bore and terminating near one end with an outwardly extending annular collar, said stem co-axially disposed and slidably engagable with said sleeve so as to be freely rotatable, said annular collar supportably engaged with said annular shoulder, and said stem adaptable for engaging the rotatable lawn sprinkler; whereby, water supplied to the stand pipe and through said bores effects common rotation of said stem and the lawn sprinkler.

2. A connector for a rotatable lawn sprinkler according to claim 1 further including a coupling affixed to said collar and couplable to said lawn sprinkler for providing communication with said sprinkler.

3. A connector for a rotatable lawn sprinkler according to claim 1 wherein said sleeve includes an enlarged section adjacent said shoulder to be adaptable for friction fit with the cylindrical stand pipe.

* * * * *